United States Patent [19]

Schroder et al.

[11] Patent Number: 4,534,290

[45] Date of Patent: Aug. 13, 1985

[54] INK FILM DISPENSING SYSTEM FOR A PRINTING PRESS

[75] Inventors: Peter Schroder; Fred Kunkel; Peter Hummel, all of Offenbach am Main, Fed. Rep. of Germany

[73] Assignee: M.A.N.-Roland Druckmaschinen Aktiengesellschaft, Fed. Rep. of Germany

[21] Appl. No.: 592,590

[22] Filed: Mar. 23, 1984

[30] Foreign Application Priority Data

Mar. 26, 1983 [DE] Fed. Rep. of Germany ..... 3311113

[51] Int. Cl.[3] ..... B41F 31/04; B41F 31/06; B41L 27/06

[52] U.S. Cl. ..... 101/365

[58] Field of Search ..... 101/365, 366, 350, 206, 101/207, 208

[56] References Cited

U.S. PATENT DOCUMENTS 4,058,058 11/1977 Hantscho ..... 101/365

4,242,958 1/1981 Jeschke ..... 101/365

4,387,648 6/1983 Jeschke et al. ..... 101/365

*Primary Examiner*—J. Reed Fisher

*Attorney, Agent, or Firm*—Leydig, Voit, Osann, Mayer & Holt, Ltd.

[57] ABSTRACT

An ink dispensing system for a printing press having an ink trough of a fountain roller and comprising a plurality of radially oriented ink spreader assemblies arranged closely side-by-side to form a substantially continuous metering edge for zonal metering of a film of ink on the fountain roller as it rotates. Each printer assembly includes a bearing member and a dispensing member, the bearing member having a tip of narrow dimension and the dispensing member having a film-forming edge. Each bearing member is biased so that its tip rides in contact with the surface of the roller to establish a positional reference for adjustment of the dispensing member. An adjusting screw mounted on the bearing member and engaging the dispensing member is adapted to retract the dispensing member a small distance rearwardly of the tip of the bearing member to thereby determine the zonal thickness of the ink film formed on the surface of the roller by the dispensing member.

14 Claims, 11 Drawing Figures

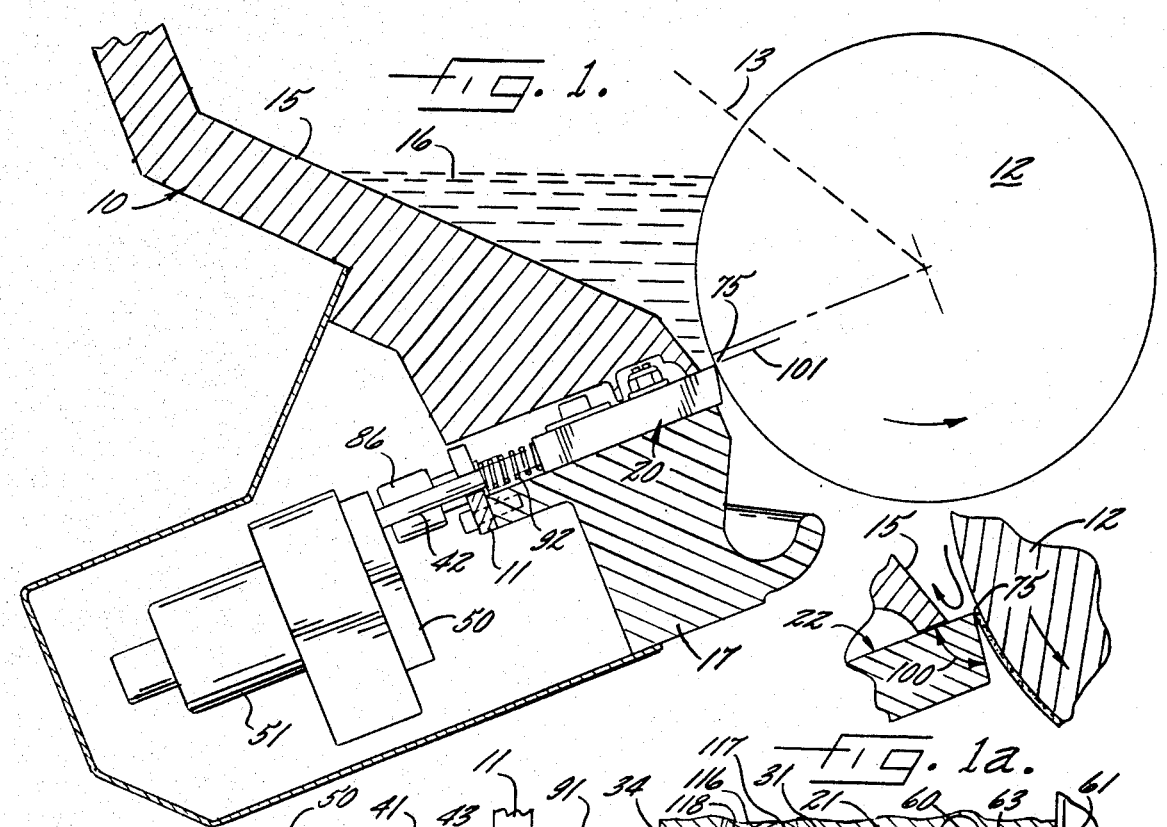
Fig. 1.
Fig. 1a.
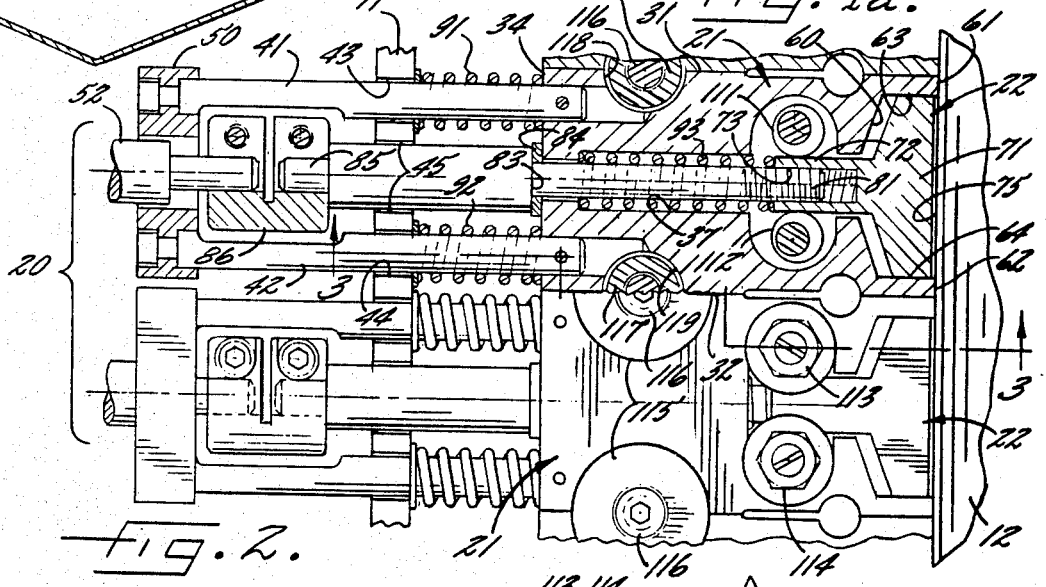
Fig. 2.
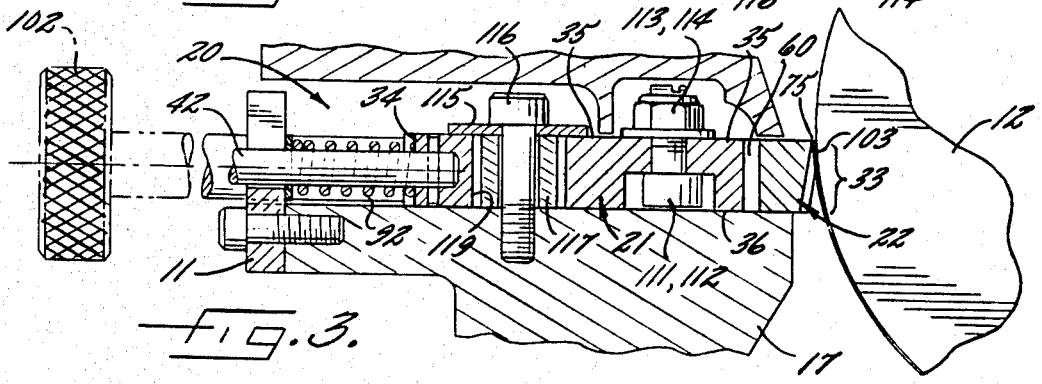
Fig. 3.

INK FILM DISPENSING SYSTEM FOR A PRINTING PRESS

DESCRIPTION OF THE INVENTION

The present invention relates to an ink dispensing system for printing presses.

Since different zones, or column positions, along the width of a printed page often require the delivery, to the respective portions of the printed page, of widely different amounts of ink, the ink fountains of conventional printing presses are divided zonally with separate adjustment of the thickness of ink fed at each zone. However even where the zone adjustment is carefully made the distance between the ink spreader, or dispensing element, and the fountain roller is subject to changes in conditions occurring in the press room as, for example, temperature changes. Moreover, the fountain roller may have a certain degree of eccentricity causing a change in thickness of the dispensed film to occur cyclically as the roller rotates.

Thus efforts have been made to relate the zonal adjustment, not to the frame of the press, but rather to the adjacent surface of the fountain roller itself. This may be done by providing, for each dispensing element, a bearing member which rides upon the surface of the roller in each particular zone and which therefore serves as a constant reference for determining the thickness of the film dispensed in the zone. Where, for example, the fountain roller is slightly eccentric, the bearing member, acting as a constant follower, will maintain precisely constant the spacing between the dispensing element and the surface of the roller over the rotative cycle.

Thus in German Auslegeschrift No. 26 48 098 there is disclosed a series of dispensing elements in zonal positions having bearing and dispensing zones disposed one beside the other. The dispensing elements are arranged tangentially with respect to the fountain roller, and the viscous ink, being drawn into the cusp between the dispensing element and the roller, creates large hydrodynamic reaction forces so that a high level of biasing force must be applied to keep the bearing element seated in position. With a high biasing force a high per unit pressure is exerted between the bearing element and the surface upon which it rides resulting in a high degree of wear.

According to German patent Specification No. 29 23 678, which shows a subsequent development, the dispensing elements are also arranged tangentially with respect to the fountain roller. Ink flows through an aperture for spreading over the full width of the zone. In this construction, too, high hydrodynamic reaction forces are encountered requiring use of high biasing forces with attendant wear.

In German patent Specification No. 30 18 784 all of the dispensing elements are formed into a continuous flexibly resilient bearing strip having rigid bearing webs. The strip is arranged tangentially, again resulting in high ink reaction forces and the necessity for using high biasing forces resulting in aggravated wear at the bearing surfaces which are employed as a reference.

To make matters worse, the reaction force of the ink upon a tangentially, or angularly, arranged dispenser does not remain constant during adjustment, but seems to be an inverse function of the thickness of the gap through which the ink is fed, with extremely high forces being encountered at, and approaching, shut-off.

Also, while it is conventional to employ an auxiliary metal layer, or "foil", for the purpose of reducing friction at the ink feeding gap and to seal the dispensing elements against ink penetration, the foil itself is subject to wear so that the dispensing elements need continuous readjustment. German Offenlegungschrift No. 2 928 125 discloses means for adjusting foil tension.

To reduce the per unit force at the bearing surfaces it is possible to increase the area in engagement but this prevents the ink from being spread over substantially the full zonal width.

It is accordingly an object of the invention to provide an ink film dispensing system of the zonal type in which a bearing member is provided in each zone for riding directly upon the surface of the fountain roller and for therefore serving as a constant reference for the adjacent ink dispensing member but in which permits light engagement between the bearing member and the fountain roller thus minimizing wear at the region of engagement. It is a related object to provide a zonal ink dispensing system employing a bearing member which serves as a constant reference for a dispensing member within a particular zone but in which the area of the bearing member in contact may be reduced to a minimum thereby enabling ink to be spread at a precisely determined thickness over substantially the entire zonal width. It is a further related object to provide an ink dispensing system of the zonal type in which the bearing member and its associated dispensing member are biased into their operating positions but in which light biasing forces may be employed without risk that the dispensing member will become dislodged to produce over-feed as a result of the reaction force of the ink particularly at narrow gap settings. Indeed, it is an object of the invention to provide an ink dispensing system of the above type which operates reliably all the way down to shut-off.

It is another object of the invention to provide an ink dispensing system employing a plurality of radially oriented ink spreader assemblies arranged closely side-by-side and individually slidable for purposes of adjustment which are effectively sealed against the possibility of ink leakage but in which the frictional forces between adjacent assemblies are extremely low to insure accurate following of the bearer, or reference, elements even with low biasing forces. It is a further object of the invention to provide an ink dispensing arrangement in a zonal type fountain which is simple and straightforward in construction, which is long-wearing, remaining highly precise over long periods of time, and which does not require resort to foils for wear and sealing purposes.

Other objects and advantages of the invention will become apparent upon reading the attached detailed description and upon reference to the drawings in which:

FIG. 1 is a vertical section taken through an ink fountain employing the present invention.

FIG. 1*a* is a fragment based on FIG. 1 but showing formation of the ink film.

FIG. 2 is a fragmentary plan view, in partial section, showing adjacent spreader assemblies, each including a bearing member and a dispensing member.

FIG. 3 is a vertical section through a spreader assembly looking along the line 3—3 in FIG. 2.

Figure 4:
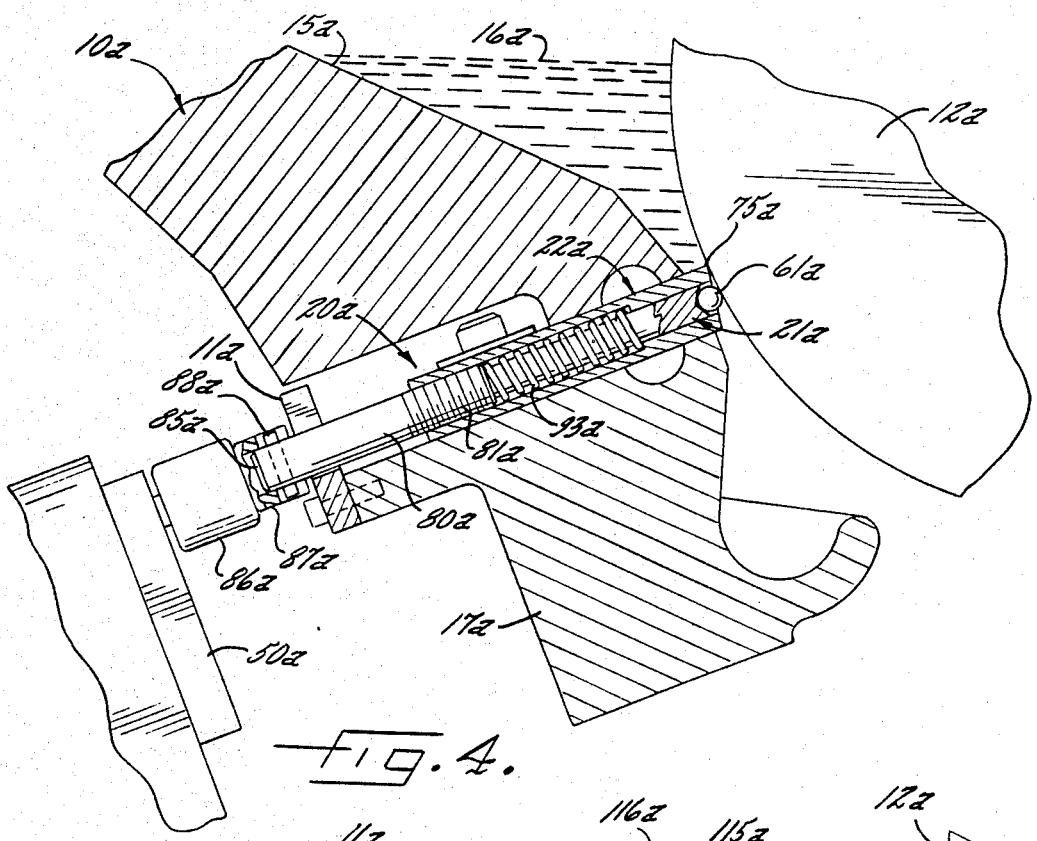
FIG. 4 is a view similar to FIG. 1 but showing a modified form of the invention.

While the invention has been described in connection with certain preferred embodiments, it will be understood that we do not intend to be limited to the particular embodiments shown but intend, on the contrary, to cover the various alternative and equivalent forms of the invention included within the spirit and scope of the appended claims.

Referring to FIG. 1, there is shown, in vertical section, an ink fountain 10 mounted upon a press frame, only a portion of which is shown at 11 and in which is journalled a fountain roller 12 which has provision for slow rotation, in the direction of the arrow, by a press drive 13. The fountain includes an ink trough 15 which extends the length of the fountain roller and which contains a body of ink 16. Extending parallel to the trough, on its underside, is a trough base member 17 which is secured at its ends (not shown) to the press frame. Between the trough 15 and trough base 17 is a working space of constant thickness occupied by a plurality of radially oriented and radially slidable ink spreader assemblies 20. The ink spreader assemblies together form a substantially continuous metering edge for zonal metering of a film of ink on the fountain roller as it rotates. Each spreader assembly is made up of two main portions, a bearing member 21 and a dispensing member 22.

The bearing member 21 is in the shape of a generally rectangular slide having parallel sides, 31, 32, a presented end 33, a rear end 34, a top surface 35 and a bottom surface 36. A longitudinal bore 37 extends therethrough. Secured to the rear end of the bearing member are a pair of guide rods 41, 42 which extend through apertures 43, 44, respectively, in the transversely extending frame member 11. The guide rods, at their rear ends, support a mounting plate 50, one for each spreader assembly, which supports a servo-motor drive 51 having a drive shaft 52.

At its presented end the bearing member 21 is centrally relieved in a forked configuration defining a central space 60 bounded by two presented tips of narrow dimension 61, 62. The tips have inwardly facing sidewalls 63, 64 which are parallel to one another.

The dispensing member 22 is slidably received within the walls 63, 64 and will be seen as of "T" shape made up of a cross leg 71 and a central leg 72, the latter having a threaded opening 73 formed in the inner end thereof. At its presented, or right-hand, end, the dispensing member has a film-forming edge 75.

In accordance with the present invention, means are provided for biasing the bearing member 21 so that the tips 61, 62 thereof ride in contact with the surface of the roller to establish a positional reference for adjustment of the dispensing member. An adjusting screw interconnects the bearing member and the dispensing member, the screw being turned so that dispensing member is retracted a small running distance rearwardly from the tip of the bearing member thereby to form a gap which determines the zonal thickness of the film left on the surface of the roller by the dispensing member. Referring to FIG. 2 of the drawings, the screw, indicated at 80, has a threaded tip 81 which screws into the threaded opening 73 in the dispensing member. The screw has an enlargement, or shoulder 83 which bears against a thrust washer 84 which in turn bears against the rear end 34 of the bearing member. At its rear end the screw has a shank 85 which is connected to the shaft 52 of the servo motor by coupling 86.

For the purpose of biasing the bearing member toward the fountain so that the tips 61, 62 thereof are maintained in constant contact with the roller, a compression spring is provided which is in two sections 91, 92 encircling the guide rods 41, 42, respectively. At their left-hand ends the springs react against the frame member 11. For the purpose of keeping the adjusting screw bottomed with respect to the bearing member 21, and for removing the effect of any play in the screw, a spring 93 is fitted in the bore 37 of the bearing member. The effect of the two springs 91, 92 therefore is to maintain the bearing member seated, in reference position, upon the fountain roller while the effect of the spring 93 is to keep the adjusting screw seated, also in reference position, upon the bearing member as well as to remove any slack in the thread of the screw.

Further in accordance with the invention the film-forming edge 75 of the dispensing member 22 is not only radially oriented but it is sharply abrupt and faced toward the body of ink so that the ink film is formed by a clean-cut shearing action free of any tendency toward wedging of the ink between the dispensing member and the roller thereby to minimize hydrodynamic reaction force of the ink against the dispensing member, especially in a radial direction. By radially abrupt is meant that the edge 75 is formed of an acute angle indicated at 100 (FIG. 1*a*) which may in practice be quite large, even approaching 90 degrees. Preferably the dispensing member is mounted so that the upper surface 35, which carries the film-forming edge 75, upon being extended along the line 101 lies below the axis of rotation of the roller as shown in FIG. 1.

It is found that use of a sharply abrupt edge facing the body of ink brings about a clean-cut shearing of the ink to form the film, with a free unobstructed flow of the discarded, or excess, ink back into the ink body as shown in FIG. 1*a* so that there is no tendency toward wedging of ink between the dispensing member and the roller, such as occurs in the prior art, with the result that the reaction force of the ink against dispensing member, especially in a radial direction, is minimized. It is therefore a further element of the invention that the biasing force exerted by the spring 91, 92 against the bearing member 21 may be substantially reduced below the forces which are commonly required, accompanied by a great reduction in the per unit bearing forces exerted by the tips 61, 62 of the bearing member against the surface of the roller. Indeed a biasing force may be used which is of a magnitude which does not substantially exceed that required to overcome sliding friction of the spreader assembly as a whole. Because of the fact that the reaction force of the ink, particularly in the radial direction, is so low as to be almost negligible, and since the bearing element may thus be kept reliably seated on the roller with such low biasing forces, it is possible to preserve a constant ink gap which may be controlled with a high degree of precision, which is independent of roller eccentricity and other structural and environmental variables, and which is accurately reproducible. For increasing or decreasing the thickness of the ink film a servo-motor 51 is simply rotated in one direction or the other by remote control, or locally. Where the control is locally done, the servo-motor 51 may be replaced by a simple knurled handwheel 102 as shown in FIG. 3.

If desired the tips 61, 62 of the bearing member may be arcuately formed as indicated at 103 (FIG. 3) to follow the contour of the roller, but the engagement should, nevertheless, be of limited peripheral extent. It is one of the features of the above construction that because of the light biasing force urging the bearing member into contact with the fountain roller, the tips 61, 62 of the bearing member may be made extremely narrow in the axial direction so that the dispensing member extends over substantially the entire zonal width. The uninked strips which exist between adjacent zones are thus so narrow that their effect is readily obliterated by the motion of the vibrated rollers as ink passes through the remainder of the inking system, a matter well understood by those skilled in the art.

In order to insure that the film-forming edge 75 of the dispensing member 22 is precisely parallel to the surface of the roller, adjustable way surfaces are provided in the bearing member for lateral adjustment of the central leg 72 of the dispensing member. Preferably this takes the form of adjustable eccentrics 111, 112 (see FIGS. 2 and 3) which are located on opposite sides of the central leg and which, once adjusted, are clamped by means of clamping nuts 113, 114 respectively. To keep the bearing members seated yet freely slidable in a radial direction so that there is no possibility of tilting as a result of the overhanging weight of the servo-motor 51, retaining disks 115 (FIG. 3) are used held in place by clamping screws 116 and which are appropriately elevated suitable spacers in the form of cylindrical bushings 117. Each retaining disk serves to loosely confine the adjacent edges of neighboring bearing members, with the edge of each bearing member being relieved by outwardly facing semi-cylindrical recesses 118, 119 which are oversized to permit limited endwise movement of the bearing member as it follows the surface of the engaged fountain roller.

Mention has been made of the openings 43, 44 and 45 in the frame member 40 for passing the guide rods and adjusting screw. It may be noted that these openings are, in fact, notches formed in the upper edge of the frame member 11 so that, during assembly, each of the spreader assemblies may, with the springs 91, 92 thereon compressed, be simply dropped into position with light pre-load—and just as easily removed for disassembly.

In the version of the inventive structure just described, the dispensing member is carried within the bearing member and the biasing springs act directly upon the bearing member. It will be seen that this situation may be reversed and that the dispensing member may be biased and extended to full zonal width, with the bearing member being contained within its width dimension. Thus reference will next be made to the embodiment of the invention disclosed in FIGS. 4 and 5 where similar reference numerals have been employed to represent similar parts with the addition of subscript "a". It will be seen that there is a fountain roller **12*a* having an associated trough 15*a* carrying a body of ink 16*a* and having a base portion 17*a*. Mounted in the space between the trough and the base portion and occupying a full zonal width is a dispensing member 22*a*. At its rear end the dispensing member carries guide rods 41*a*, 42*a* which support a mounting plate 50*a* on which the servo-motor (not shown) is fixed. Telescoped over the guide rods are respective biasing springs 91*a*, 92*a*, which react against frame member 11*a* to bias the dispensing member 22*a* to the right, that is, in the direction of the roller. In this embodiment the bearing member 21*a* having a presented tip 61*a* is secured to the front end of an adjusting screw 80*a* which penetrates the dispensing member and which has a threaded connection 81*a* therewith. The rear end 85*a* of the adjusting screw is connected by a coupling 86*a* to the servo-motor (not shown) which is supported on the mounting plate 50*a*. In this embodiment of the invention the coupling 86*a* includes a rudimentary form of splined connection 87*a* having a cross pin 88 to accommodate the relative adjustable extension of the adjusting screw with respect to the dispensing member to which the mounting plate 50*a*** is now secured.

Just as in the previous embodiment the film-forming edge **75*a* of the dispensing member 22*a*** is sharply abrupt and faced toward the body of ink so that the ink film is formed by a clean-cut shearing action, free of any tendency toward wedging of the ink between the dispensing member and the roller.

In operation the adjusting screw **80*a*, which carries the bearing member 21*a*, is turned so that the tip 61*a* of the bearing member projects slightly beyond the dispensing member; in other words, the screw is turned so that the dispensing member is relatively retracted, or offset, to establish a small running distance between the dispensing member and the roller to form the ink gap. Because the dispensing member 22*a* and the bearing member 21*a*** are precisely related in position by the adjusting screw, the thickness of ink film at the zonal position remains constant regardless of temperature and other variations within the press room and regardless of any eccentricity of the surface of the fountain roller, just as in the previous embodiment.

Importantly, and as in the previous embodiment, very light biasing forces may be utilized, at a level of magnitude which does not substantially exceed that required to overcome sliding friction of the assembly so that the force exerted by the bearing member against the roller surface may be very light, while assuring that contact is constantly maintained between the tip of the bearing member and the roller. As a result, the bearing area may be reduced to an extremely low level without developing a per unit pressure which is high enough to cause wear. Thus it is preferred that the tip of the bearing member be spherical which provides little more than point contact. This means that the uninked area at the point of bearing engagement will be of very narrow width easily obliterated by the action of the vibrated rollers along the path of the inking system.

Figure 5:
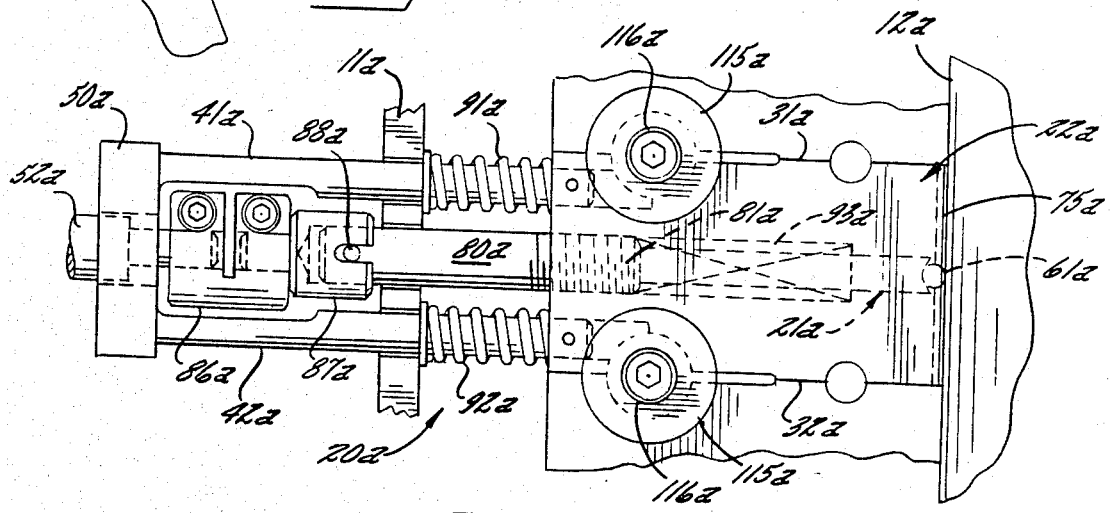
FIG. 5 is a plan view of one of the spreader assemblies of FIG. 4.
Figure 6:
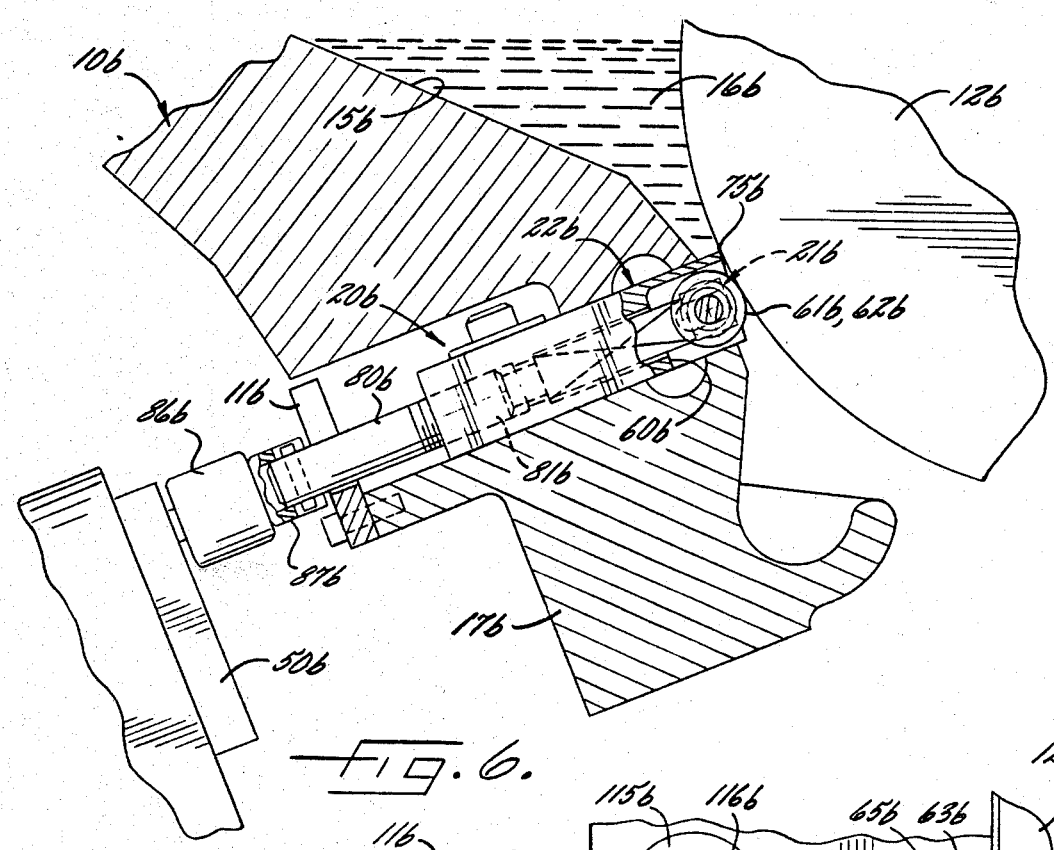
FIG. 6 is a vertical section showing a further embodiment of the invention employing rollers as bearing elements.
Figure 7:
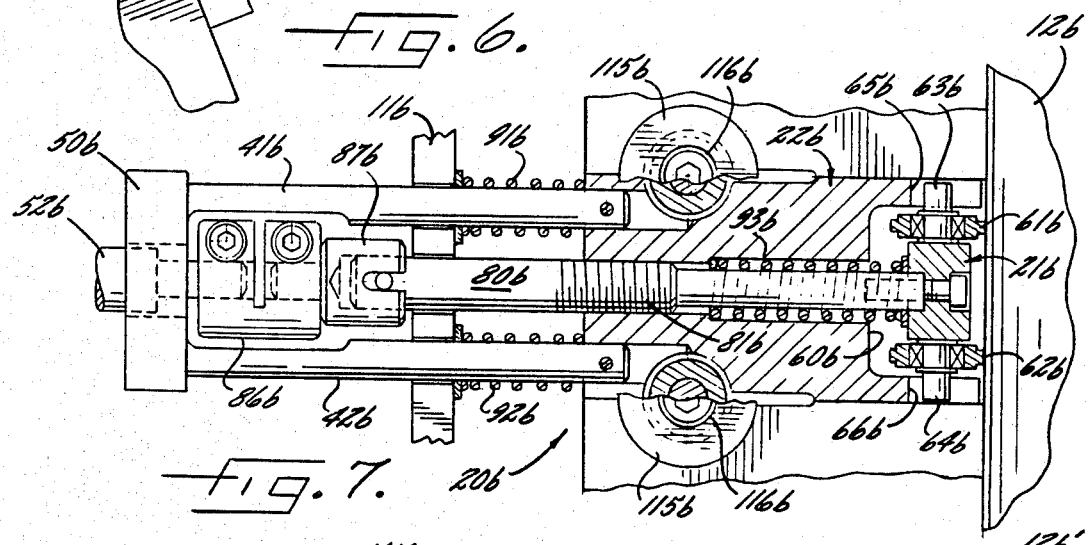
FIG. 7 is a plan view of a spreader assembly of FIG. 6 with a portion broken away to reveal the rollers.

A further alternative structure similar to that shown in FIGS. 4 and 5 is set forth in FIGS. 6 and 7 where similar reference numerals have been used to indicate similar elements with the addition of subscript "b". In this embodiment the tip of the bearing member which engages the roller surface is replaced by small auxiliary rollers **61*b*, 62*b* which are mounted upon bearing member 21*b* received within a recess 60*b* formed in the front edge of the dispensing member 22*b*. To prevent the axis of the auxiliary rollers from twisting out of their desired plane small stub shafts 63***b*, 64*b* which mount the rollers are extended into way surfaces in the form of grooves 65*b*, 66*b*, respectively. The adjusting screw is provided with a spline type drive connection 87*b*. The use of auxiliary rollers prevents any possibility of abrasion against the surface of the fountain roller. An extremely light biasing force may be used as in the previously described embodiments and for this reason the roller peripheries may be sharpened almost to a higher edge producing correspondingly narrow uninked grooves which are readily obliterated by the vibrating rollers later in the system.

Figure 8:
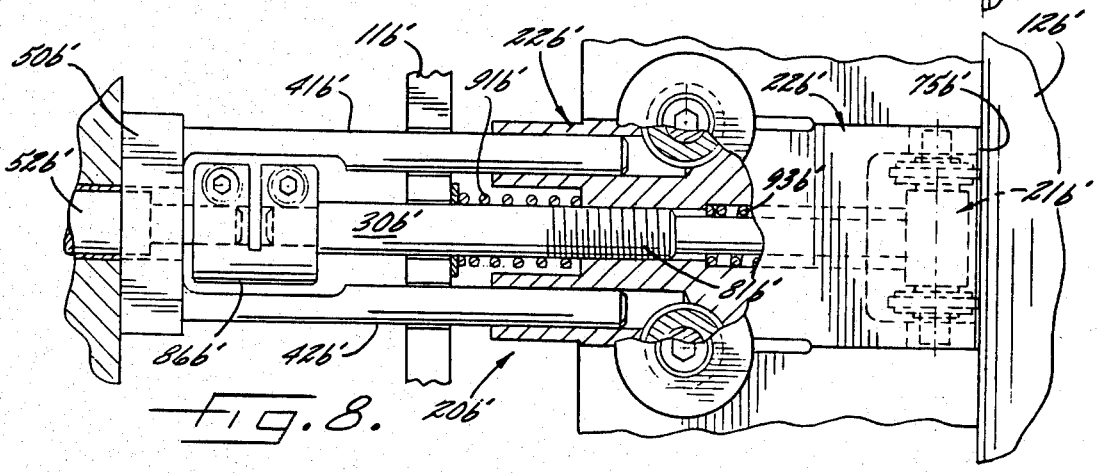
FIG. 8 is a view similar to FIG. 7 but showing a slightly modified construction.

As a variant of the embodiment shown in FIGS. 6 and 7 the structure of FIG. 8 may be used, bearing primed numerals, in which the screw drive is made to float by telescoping the guide rods 41*b*', 42*b*' freely in the dispensing member 22*b*', thereby enabling the spline type drive connection (87*b* in FIG. 7) to be omitted.

Figure 9:
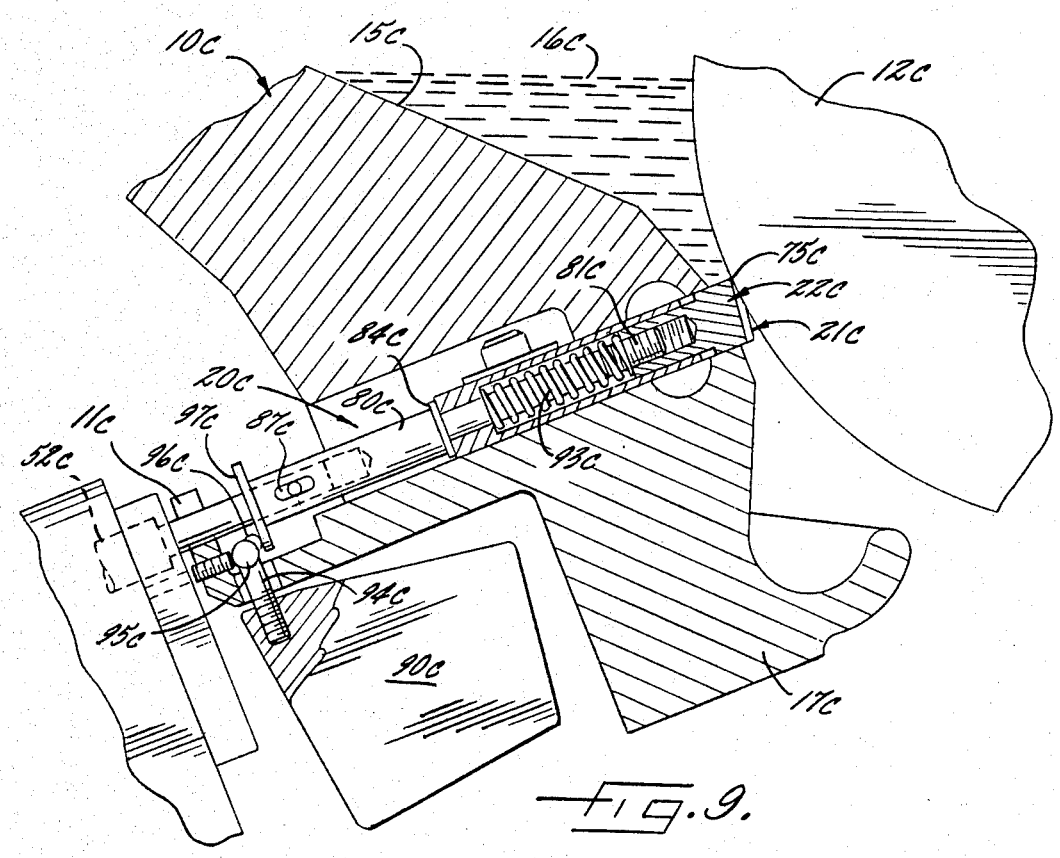
FIG. 9 shows a further embodiment of the invention similar to that shown in FIG. 1 but with a weight employed for biasing purposes rather than a spring.
Figure 10:
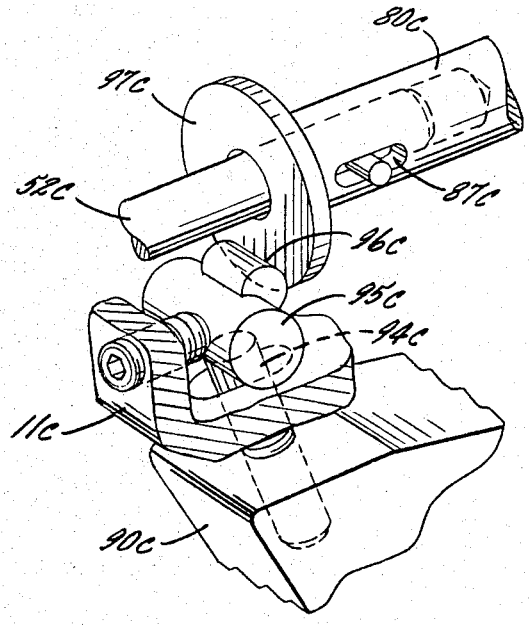
FIG. 10 is a fragmentary perspective view of the force-transmitting linkage in FIG. 9.

While the various embodiments which have been already described employ springs for generating biasing forces, it will be apparent to one skilled in the that it is not necessary to employ springs for this purpose and that gravity biasing may be used if desired. Such is shown in FIGS. 9 and 10 in which the biasing springs 91, 92 (see FIG. 2) have been replaced by a pivoted weight having an arm which bears upon the shoulder of the adjusting screw. In FIGS. 9 and 10 similar elements have been denoted by similar reference numerals with the addition of subscript "c". Thus a weight 90*c* supported upon an integral arm 94*c* is pivoted at 95*c* for horizontal rocking movement. The arm 94*c* carries an eccentric 96*c* which engages a circular flange 97*c* on the adjusting screw 80*c*. The force more or less horizontally applied to the adjusting screw not only performs the biasing functions of the springs 91, 92 which bias the bearing member but also the seating function of the spring 93 which biases the screw. Thus it will be apparent that when the described linkage applies endwise force to the adjusting screw it is maintained in a bottomed position on the bearing member 21*c* via the thrust washer 84*c*, and the force transmitted through such washer, at the same time, biases the bearing member so that it remains in contact with the surface of the fountain roller. Thus the term "biasing means" as employed herein and will be understood to include both spring bias and gravity bias.

It is one of the features of the present construction that the amount of sliding friction of each spreader assembly with respect to its neighbors is minimized. Since the forces acting upon each spreader assembly (ink reaction forces and biasing forces) are small, the assembly may be made free-sliding and more compact than if heavy forces had to be resisted. Moreover, the lateral surfaces of each spreader assembly may be lubricated with a lubricant which not only makes the assembly free-sliding but which resists leakage of ink between adjacent assemblies, such lubricants being well-known in the art.

It is one of the main features of the present invention that the biasing forces applied to the bearing and dispensing elements need not be sufficiently high as to resist the hydrodynamic forces exerted by the ink as the ink crowds tightly into a wedge-shaped space prior to being deposited, as a film, on the fountain roller. As stated, this enables much lighter biasing forces to be used, forces which do not substantially exceed that required to overcome sliding friction. It will be understood however that the present structure does not preclude the use of heavier spring forces, it is simply that such heavy spring forces are, in accordance with the present teachings, unnecessary so that the degree of wear may be substantially reduced.

The spreading assemblies 20 have been spoken of as "radially oriented". While true radial orientation has been illustrated in FIG. 1 it will be understood that the spreader assemblies are oriented generally along the roller radius and may be cocked upwardly or downwardly over a small angle without departing from the invention.

Also, while the invention has been described above in connection with an overshot fountain, it will be understood that the invention may be applied with equal adavntage to fountains of the undershot type. Under such circumstances, however, the spreader assemblies will be inverted consistently with a reversal of the direction of rotation of the fountain roller so that the face of the dispensing member which carries the film-forming edge will be faced toward the body of ink to preserve the clean-cut shearing action and to avoid any wedging of the ink between the dispensing member and the roller.

We claim as our invention:

1. In an ink dispensing system for a printing press, the combination comprising a frame, a slowly rotated fountain roller, an ink trough on the frame extending the length of the fountain roller for containing a body of ink, a trough base member extending parallel to the trough and defining with the trough a working space of constant thickness, a plurality of radially oriented ink spreader assemblies arranged closely side-by-side in the working space individually slidable and together forming a substantially continuous metering edge for zonal metering of a film of ink on the fountain roller as it rotates, each spreader assembly including a bearing member and a dispensing member, the bearing member having a presented tip of narrow dimension and the dispensing member having a presented film-forming edge, means for biasing the bearing member so that its tip rides in contact with the surface of the roller to establish a positional reference for adjustment of the dispensing member, an adjusting screw mounted on the bearing member and engaging the dispensing member, means for turning the adjusting screw so that the dispensing member is retracted a small running distance rearwardly of the tip of the bearing member thereby to determine the zonal thickness of the ink film formed on the surface of the roller by the dispensing member, the film-forming edge of the dispensing member being sharply abrupt and being faced toward the body of ink so that the ink film is formed by a clean-cut shearing action free of any tendency toward wedging of the ink between the dispensing member and the roller thereby to minimize reaction force of the ink against the dispensing member especially in a radial direction, the biasing means including means reacting against the press frame for applying bias at a level of magnitude which does not substantially exceed that required to overcome sliding friction of the assembly thereby to minimize the force of the bearing member against the surface of the roller while maintaining (a) the tip of the bearing member constantly seated on the roller surface and (b) the dispensing member at the predetermined running distance from the roller surface.

2. In an ink dispensing system for a printing press, the combination comprising a frame, a slowly rotated fountain roller, means extending the length of the fountain roller for containing a body of ink, a plurality of radially oriented ink spreader assemblies arranged closely side-by-side on the frame individually slidable and together forming a substantially continuous metering edge for zonal metering of a film of ink on the fountain roller as it rotates, each spreader assembly including a bearing member and a dispensing member, the bearing member having a presented tip of narrow dimension and the dispensing member having a presented film-forming edge, means for biasing the bearing member so that its tip rides in contact with the surface of the roller to establish a positional reference for adjustment of the dispensing member, an adjusting member mounted on the bearing member and engaging the dispensing member, means for moving the adjusting member so that the dispensing member is retracted a small running distance rearwardly of the tip of the bearing member thereby to determine the zonal thickness of the ink film formed on the surface of the roller by the dispensing member, the film forming edge of the dispensing member being sharply abrupt and being faced toward the body of ink so that the ink film is formed by a clean-cut shearing action free of any tendency toward wedging of the ink between the dispensing member and the roller thereby to minimize reaction force of the ink against the dispensing member especially in a radial direction, the biasing means including means reacting against the press frame for applying bias at a level of magnitude which does not substantially exceed that required to overcome sliding friction of the assembly thereby to minimize the force of the bearing member against the surface of the roller while maintaining (a) the tip of the bearing member constantly seated on the roller surface and (b) the dispensing member at the predetermined running distance from the roller surface.

3. In an ink dispensing system for a printing press, the combination comprising a frame, a slowly rotated fountain roller, an ink trough on the frame extending the length of the fountain roller for containing a body of ink, a trough base member extending parallel to the trough and defining with the trough a working space of constant thickness, a plurality of radially oriented ink spreader assemblies arranged closely side-by-side in the working space individually slidable and together forming a substantially continuous metering edge for zonal metering of a film of ink on the fountain roller as it rotates, the bearing member being centrally relieved adjacent the roller in a forked configuration to define a central space bounded by two presented tips of narrow dimension, the dispensing member having a presented film-forming edge and mounted for adjustable sliding movement in the central space occupying substantially the entire width of the central space, means for biasing the bearing member so that the presented tips ride in contact with the surface of the roller to establish a positional reference for adjustment of the dispensing member, an adjusting screw mounted on the bearing member and engaging the dispensing member, means for turning the adjusting screw so that the dispensing member is retracted a slight distance rearwardly of the tips of the bearing member thereby to determine the zonal thickness of the ink film formed on the surface of the roller by the dispensing member, the film forming edge of the dispensing member being sharply abrupt and being faced toward the body of ink so that the ink film is formed by a clean-cut shearing action free of any tendency toward wedging of the ink between the dispensing member and the roller thereby to minimize reaction force of the ink against the dispensing member especially in a radial direction, the biasing means including means reacting against the press frame for applying bias at a level of magnitude which does not substantially exceed that required to overcome sliding friction of the assembly thereby to minimize the force of the bearing member against the surface of the roller while maintaining (a) the tips of the bearing member constantly seated on the roller surface and (b) the dispensing member at the predetermined running distance from the roller surface.

4. In an ink dispensing system for a printing press, the combination comprising a frame, a slowly rotated fountain roller, means extending the length of the fountain roller for containing a body of ink, a plurality of radially oriented ink spreader assemblies arranged closely side-by-side on the frame individually slidable and together forming a substantially continuous metering edge for zonal metering of a film of ink on the fountain roller as it rotates, each spreader assembly including a bearing member and a dispensing member, the bearing member having a presented tip of narrow dimension and the dispensing member having a presented film forming edge, means for biasing the bearing member so that its tip rides in contact with the surface of the roller to establish a positional reference for adjustment of the dispensing member, an adjusting screw for coupling together the bearing member and dispensing member with means for turning the same so that the dispensing member is retracted a small running distance rearwardly of the tip of the bearing member, thereby to determine the zonal thickness of the ink film formed on the surface of the roller by the dispensing member, the dispensing member extending the full zonal width and the bearing member being located within the width dimension of the dispensing member, the film forming edge of the dispensing member being sharply abrupt and being faced toward the body of ink so that the ink film is formed by a clean-cut shearing action free of any tendency toward wedging of ink between the dispensing member and the roller thereby to minimize reaction force of the ink against the dispensing member especially in a radial direction, biasing means including means reacting against the press frame for applying bias at a level of magnitude which does not substantially exceed that required to overcome sliding friction of the assembly thereby to minimize the force exerted by the bearing member against the roller surface while maintaining the bearing member constantly seated on the roller surface and the dispensing member at predetermined running distance from the roller surface.

5. In an ink dispensing system for a printing press, the combination comprising a frame, a slowly rotated fountain roller, an ink trough on the frame extending the length of the fountain roller, an ink trough on the frame extending the length of the fountain roller for containing a body of ink, a trough base member extending parallel to the trough and defining with the trough a working space of constant thickness, a plurality of radially oriented ink spreader assemblies arranged closely side-by-side in the working space individually slidable and together forming a substantially continuous metering edge for zonal metering of a film of ink on the fountain roller as it rotates, each spreader assembly including a bearing member and a dispensing member, the bearing member having a presented tip of narrow dimension and the dispensing member having a presented film-forming edge, a first spring reacting against the frame biasing the bearing member so that its tip rides in contact with the surface of the roller to establish a positional reference for adjustment of the dispensing member, an adjusting screw on the bearing member and engaging the dispensing member, a second spring for maintaining the adjusting screw bottomed with respect to the bearing member and for taking up any play in the adjusting screw, means for turning the adjusting screw so that the dispensing member is retracted a small running distance rearwardly of the tip of the bearing member thereby to determine the zonal thickness of the ink film formed on the surface of the roller by the dispensing member, the film forming edge of the dispensing member being sharply abrupt and being faced toward the body of the ink so that the ink film is formed by a clean-cut shearing action free of any tendency toward wedging of the ink between the dispensing member and the roller thereby to minimize reaction force of the ink in the dispensing member especially in a radial direction.

6. In an ink dispensing system for a printing press, the combination comprising a frame, a slowly rotated fountain roller, an ink trough on the frame extending the length of the fountain roller for containing a body of ink, a trough base member extending parallel to the trough and defining with the trough a working space of constant thickness, a plurality of radially oriented ink spreader assemblies arranged closely side-by-side in the working space individually slidable and together forming a substantially continuous metering edge for zonal metering of a film of ink on the fountain roller as it rotates, each spreader assembly including a bearing member and a dispensing member, the dispensing member having a presented film-forming edge extending the full zonal width, the bearing member including an adjusting screw which is threaded into the dispensing member and having a tip portion of narrow dimension which rides in contact with the surface of the roller to establish a positional reference for the dispensing member, a biasing spring interposed between the dispensing member and the frame of the press so that the tip of the bearing member is maintained in contact with the surface of the roller, means for turning the adjusting screw so that the dispensing member is retracted a small running distance rearwardly of the tip of the bearing member thereby to predetermine the zonal thickness of the ink film formed on the surface of the roller by the dispensing member, the film forming edge of the dispensing member being sharply abrupt and being faced toward the body of ink so that the ink film is formed by a clean-cut shearing action free of any tendency toward wedging of ink between the dispensing member and the roller thereby to minimize reaction force of the ink against the dispensing member especially in a radial direction, the biasing spring being prestressed to a level which does not substantially exceed that required to overcome the sliding friction of the assembly thereby to minimize the force exerted by the tip of the bearing member against the surface of the roller while maintaining the bearing member constantly seated on the roller surface and the dispensing member at the predetermined running distance from the roller surface.

7. In an ink dispensing system for a printing press, the combination comprising a frame, a slowly rotated fountain roller, means extending the length of the fountain roller for containing a body of ink, a plurality of radially oriented ink spreader assemblies arranged closely side-by-side on the frame individually slidable and together forming a substantially continuous metering edge for zonal metering of a film of ink on the fountain roller as it rotates, each spreader assembly including a bearing member and a dispensing member, the bearing member being centrally relieved adjacent the roller in a forked configuration defining a central space having parallel walls terminating in a pair of presented tips of narrow dimension, the dispensing member being slidably fitted within the walls and having a presented film-forming edge, the dispensing member being of "T" shape with the central leg of the "T" being slidably received in the bearing member, a biasing spring interposed between the frame and the bearing member for biasing the bearing member so that its tips ride in contact with the surface of the roller to establish a positional reference for the dispensing member, means including an adjusting screw for interengaging the bearing member and dispensing member so that the dispensing member may be retracted a small running distance rearwardly of the tips of the bearing member thereby to determine the zonal thickness of the ink film formed on the surface of the roller by the dispensing member, the film forming edge of the dispensing member being sharply abrupt and being faced toward the body of ink so that the ink film is formed by a clean-cut shearing action free of any tendency toward wedging of ink between the dispensing member and roller thereby to minimize reaction force of the ink against the dispensing member especially in a radial direction, the spring being preloaded to apply bias to the bearing member at a level which does not substantially exceed that required to overcome friction thereby to minimize the force exerted by the tips of the bearing member against the roller while maintaining the bearing member constantly seated on the roller surface and the dispensing member at the predetermined running distance from the roller surface.

8. The combination as claimed in claim 1 or in claim 2 or in claim 3 or in claim 5 or in claim 7 in which the tip of the bearing member is arcuate conforming to the curvature of the roller but of limited peripheral extent.

9. The combination as claimed in claim 1 or in claim 2 or in claim 4 or in claim 6 in which the tip of the bearing member is substantially spherical to minimize the area of the tip of the bearing member which is in engagement with the surface of the roller.

10. The combination as claimed in claim 1 or in claim 2 or in claim 4 or in claim 6 in which the tip of the bearing member is in the form of a roller pivoted to the bearing member for rotation about an axis parallel to the roller axis.

11. The combination as claimed in claim 1 or in claim 2 or in claim 3 or in claim 4 or in claim 5 or in claim 6 or in claim 7 in which the upper surface of the spreading assembly contains the film-forming edge and in which such upper surface, upon being extended, lies closely adjacent the roller axis.

12. The combination as claimed in claim 7 in which adjustable way surfaces are provided in the bearing member for lateral adjustment of the central leg of the T-shaped dispensing member so that the presented film-forming edge of the latter is precisely parallel to the adjacent surface of the fountain roller.

13. The combination as claimed in claim 7 in which adjustable eccentrics are mounted in the bearing member on respectively opposite sides of the central leg of the T-shaped dispensing member to serve as opposed way surfaces therefor with means for clamping the eccentrics in position to define a line of movement of the dispensing member which orients the film-forming edge thereon precisely parallel to the adjacent surface of the fountain roller.

14. The combination as claimed in claim 1 in which the biasing means is in the form of a suspended weight having linkage for transmitting the force of gravity acting upon such weight to the bearing member to maintain the same in reference position in contact with the roller surface.

* * * * *